US011330954B2

(12) United States Patent
Dehn

(10) Patent No.: US 11,330,954 B2
(45) **Date of Patent: *May 17, 2022**

(54) STEAM NOZZLE SYSTEM AND METHOD

(71) Applicant: ECP INCORPORATED, Woodridge, IL (US)

(72) Inventor: Dennis Dehn, Dallas, TX (US)

(73) Assignee: ECP INCORPORATED, Woodridge, IL (US)

( * ) Notice: Subject to any disclaimer, the term of this patent is extended or adjusted under 35 U.S.C. 154(b) by 437 days.

This patent is subject to a terminal disclaimer.

(21) Appl. No.: 16/251,849

(22) Filed: Jan. 18, 2019

(65) Prior Publication Data

US 2019/0191953 A1 Jun. 27, 2019

Related U.S. Application Data

(62) Division of application No. 13/922,463, filed on Jun. 20, 2013, now Pat. No. 10,182,696.

(60) Provisional application No. 61/731,990, filed on Nov. 30, 2012, provisional application No. 61/706,456, filed on Sep. 27, 2012.

(51) Int. Cl.
*A47L 11/34* (2006.01)
*A47L 11/40* (2006.01)

(52) U.S. Cl.
CPC ..... *A47L 11/4086* (2013.01); *A47L 11/34* (2013.01)

(58) Field of Classification Search
CPC ..... A47L 11/34; A47L 11/4086; A47L 9/02; A47L 9/242; A47L 9/06; A47L 9/0613; A47L 7/0009; A47L 11/40; A47L 11/408; A47L 11/4083; A47L 11/4088
See application file for complete search history.

(56) References Cited

U.S. PATENT DOCUMENTS

| | | | | |
|---|---|---|---|---|
| 1,720,165 A | | 7/1929 | Neff | |
| 2,270,579 A | | 1/1942 | Bassett | |
| 2,679,084 A | | 5/1954 | Heitt | |
| 2,933,093 A | * | 4/1960 | Handyside | B05B 3/066 134/168 R |
| 3,727,949 A | | 4/1973 | Kleykamp | |

(Continued)

FOREIGN PATENT DOCUMENTS

| | | |
|---|---|---|
| DE | 1806634 | 5/1970 |
| EP | 2255885 | 12/2010 |

(Continued)

OTHER PUBLICATIONS

Notice of Allowance for U.S. Appl. No. 16/257,943 dated May 6, 2019.

(Continued)

*Primary Examiner* — Robert J Scruggs
(74) *Attorney, Agent, or Firm* — Kowert, Hood, Munyon, Rankin & Goetzel, P.C.; Gareth M. Sampson

(57) ABSTRACT

Steam cleaning spray nozzle systems and methods of use are described herein. The spray nozzle includes a substantially rigid conduit a support member in fluid communication with a steam source. A portion of the conduit is angled. During use, sufficient eccentric force is produced by the steam to rotate the support member such that steam is ejected from the substantially rigid conduit at an oblique angle relative to the center to of the substantially rigid conduit.

17 Claims, 8 Drawing Sheets

(56) References Cited

U.S. PATENT DOCUMENTS

| | | | | |
|---|---|---|---|---|
| 4,044,953 | A | 8/1977 | Vogel | |
| 4,369,850 | A | 1/1983 | Barker | |
| 4,370,771 | A | 2/1983 | Gonzalvo | |
| 4,841,760 | A | 6/1989 | Ferguson | |
| 5,052,623 | A | 10/1991 | Nordeen | |
| 5,533,673 | A | 7/1996 | Wilson et al. | |
| 5,725,153 | A | 3/1998 | Wang et al. | |
| 5,795,626 | A * | 8/1998 | Gabel | B05B 5/047 427/458 |
| 6,003,787 | A | 12/1999 | Fisher | |
| 6,126,086 | A | 10/2000 | Browner et al. | |
| 6,178,570 | B1 | 1/2001 | Denst et al. | |
| 6,490,753 | B1 | 12/2002 | Chen | |
| 6,609,269 | B2 | 8/2003 | Kasper | |
| 6,860,437 | B1 | 3/2005 | Amendt et al. | |
| 6,883,732 | B2 * | 4/2005 | Hasegawa | B05B 3/00 239/318 |
| 7,032,837 | B2 | 8/2006 | Eddins et al. | |
| 7,225,503 | B1 | 6/2007 | Lenkiewicz et al. | |
| 7,458,485 | B2 | 12/2008 | Amron | |
| 7,530,474 | B2 | 5/2009 | Amron | |
| 7,568,635 | B2 | 8/2009 | Micheli | |
| 7,753,059 | B2 | 7/2010 | Hasegawa | |
| 7,784,148 | B2 | 8/2010 | Lenkiewicz et al. | |
| 7,878,423 | B2 | 2/2011 | Hasegawa | |
| 8,336,789 | B2 | 12/2012 | Kuo | |
| 8,353,467 | B2 | 1/2013 | Hasegawa | |
| 8,480,011 | B2 | 7/2013 | Endo | |
| 8,534,301 | B2 | 9/2013 | Nottingham | |
| 8,690,077 | B2 | 4/2014 | Sendo | |
| 8,807,453 | B2 | 8/2014 | Bosua | |
| 8,985,360 | B2 | 3/2015 | Chen | |
| 9,144,810 | B2 | 9/2015 | Bosua | |
| 9,211,560 | B1 | 12/2015 | Chen | |
| 9,475,071 | B2 | 10/2016 | Endo | |
| 9,597,694 | B2 | 3/2017 | Bosua | |
| 10,182,696 | B2 * | 1/2019 | Dehn | A47L 11/34 |
| 10,189,034 | B2 | 1/2019 | Endo | |
| 10,343,177 | B1 | 7/2019 | Endo | |
| 2003/0029933 | A1 | 2/2003 | Hasegawa | |
| 2003/0182755 | A1 * | 10/2003 | Dicioccio | B60S 3/008 15/321 |
| 2003/0213481 | A1 | 11/2003 | Bell | |
| 2004/0149836 | A1 | 8/2004 | Herhold | |
| 2005/0173559 | A1 | 8/2005 | Eddins et al. | |
| 2006/0065760 | A1 | 3/2006 | Micheli | |
| 2006/0208104 | A1 | 9/2006 | DeBoer | |
| 2008/0048056 | A1 | 2/2008 | Pichler | |
| 2008/0197067 | A1 | 8/2008 | Ross et al. | |
| 2009/0057443 | A1 * | 3/2009 | Sendo | B08B 3/026 239/405 |
| 2009/0065607 | A1 | 3/2009 | Gardner | |
| 2009/0078293 | A1 | 3/2009 | Hasegawa | |
| 2009/0188067 | A1 | 7/2009 | White et al. | |
| 2009/0208367 | A1 | 8/2009 | Calio | |
| 2010/0176219 | A1 | 7/2010 | Hasegawa | |
| 2010/0320289 | A1 * | 12/2010 | Kuo | B05B 7/2435 239/290 |
| 2011/0232685 | A1 | 9/2011 | Paffrath | |
| 2012/0286065 | A1 | 11/2012 | Lin | |
| 2012/0286071 | A1 | 11/2012 | Lin | |
| 2013/0001318 | A1 | 1/2013 | Endo | |
| 2014/0008457 | A1 * | 1/2014 | Bosua | B05B 3/02 239/104 |
| 2014/0061334 | A1 | 3/2014 | Liao | |
| 2014/0083467 | A1 | 3/2014 | Dehn | |
| 2014/0224278 | A1 | 8/2014 | Endo | |
| 2015/0000705 | A1 | 1/2015 | Dehn | |
| 2015/0375272 | A1 | 12/2015 | Dehn | |
| 2017/0113234 | A1 | 4/2017 | Endo | |
| 2019/0191953 | A1 | 6/2019 | Dehn | |
| 2019/0193094 | A1 | 6/2019 | Endo | |

FOREIGN PATENT DOCUMENTS

| | | |
|---|---|---|
| EP | 2587082 | 5/2013 |
| JP | H0437635 | 2/1992 |
| JP | H10286494 | 10/1998 |
| JP | H11123350 | 5/1999 |
| JP | 200051800 | 2/2000 |
| JP | 2001104840 | 4/2001 |
| JP | 2003154294 | 5/2003 |
| JP | 2007228900 | 9/2007 |
| JP | 2007228901 | 9/2007 |
| TW | 242279 | 3/1995 |
| TW | M260325 | 4/2005 |
| TW | 200603895 | 2/2006 |
| TW | 200840650 | 10/2008 |
| TW | 201244828 | 11/2012 |
| TW | M442195 | 12/2012 |
| TW | M472566 | 2/2014 |
| TW | 201524609 | 7/2015 |
| TW | I617360 | 3/2018 |
| WO | 1996013333 | 5/1996 |
| WO | 1997039620 | 10/1997 |
| WO | 2007006074 | 1/2007 |
| WO | 2007131533 | 11/2007 |
| WO | 2013060794 | 5/2013 |
| WO | 2013140173 | 9/2013 |

OTHER PUBLICATIONS

Non-Final Office Action for U.S. Appl. No. 16/418,347 dated Sep. 30, 2019.

Non-Final Office Action for U.S. Appl. No. 14/321,196 dated Apr. 29, 2019.

NPL06_Petition of Invalidation Action for Taiwanese Application No. 103135808 dated approximately Sep. 2, 2019 (including translation).

Non-Final Office Action for U.S. Appl. No. 14/801,325 dated Sep. 29, 2019.

Co-Pending U.S. Appl. No. 16/257,943 entitled, "Nozzle System and Method" to Endo filed Jan. 25, 2019.

Final Office Action for U.S. Appl. No. 14/321,196 dated Dec. 20, 2018.

Non-Final Office Action for U.S. Appl. No. 14/801,325 dated Dec. 13, 2018.

Final Office Action for U.S. Appl. No. 14/801,325 dated Apr. 4, 2019.

Notice of Allowance for U.S. Appl. No. 15/293,987 dated Oct. 1, 2018.

Advisory Action for U.S. Appl. No. 13/922,463 dated Feb. 13, 2018.

Notice of Allowance for U.S. Appl. No. 13/922,463 dated Sep. 12, 2018.

Non-Final Office Action for U.S. Appl. No. 16/257,943 dated Apr. 2, 2019.

NPL04—https://omnexus.specialchem.com/product-categories/thermoplastics-pp-polypropylene#Patents.

Non-Final Office Action for U.S. Appl. No. 13/922,463 dated Mar. 19, 2018.

Non-Final Office Action for U.S. Appl. No. 14/321,196 dated Mar. 15, 2018.

NPL02_Notice of Allowance for Taiwanese Application No. 103135808 dated approximately Dec. 12, 2017 (including translation).

NPL03_Petition of Invalidation Action for Taiwanese Application No. 103135808 dated approximately May 16, 2018 (including translation).

Final Office Action for U.S. Appl. No. 14/801,325 dated Mar. 8, 2018.

Non-Final Office Action for U.S. Appl. No. 15/293,987 dated Jun. 15, 2018.

Advisory Action for U.S. Appl. No. 14/801,325 dated Jul. 16, 2018.

NPL05_Claim Construction Order from United States District Court Central District of California, *Total Import Solutions, Inc.* v. *Dehn's Innovations LLC*, Judge Andre Birotte Jr., Case No. CV 17-03917-AB (AFMx) issued Jul. 11, 2018, pp. 19.

(56) References Cited

OTHER PUBLICATIONS

Notice of Allowance for U.S. Appl. No. 12/204,646 dated May 17, 2013.
Notice of Allowance for U.S. Appl. No. 13/530,987 dated Jan. 9, 2014.
Notice of Allowance for U.S. Appl. No. 14/182,012 dated Jul. 6, 2016.
Final Office Action for U.S. Appl. No. 16/418,347 dated Jan. 13, 2020.
Notice of Allowance for U.S. Appl. No. 16/418,347 dated May 22, 2020.
Notice of Allowance for U.S. Appl. No. 10/084,629 dated Jul. 7, 2004.
Advisory Action for U.S. Appl. No. 14/321,196 dated Jan. 16, 2018.
Advisory Action for U.S. Appl. No. 14/321,196 dated Mar. 22, 2019.
NOA for U.S. Appl. No. 14/321,196 dated Oct. 9, 2019.
Advisory Action for U.S. Appl. No. 14/801,325 dated Jul. 16, 2019.
Final Office Action for U.S. Appl. No. 14/801,325 dated May 21, 2020.
Non-Final Office Action for U.S. Appl. No. 14/182,012 dated Sep. 18, 2015.
Final Office Action for U.S. Appl. No. 14/182,012 dated Mar. 7, 2016.
Non-Final Office Action for U.S. Appl. No. 13/922,463 dated Sep. 29, 2016.
Non-Final Office Action for U.S. Appl. No. 13/922,463 dated May 16, 2017.
Final Office Action for U.S. Appl. No. 13/922,463 dated Nov. 1, 2017.
Non-Final Office Action for U.S. Appl. No. 14/321,196 dated Apr. 17, 2017.
Final Office Action for U.S. Appl. No. 14/321,196 dated Oct. 2, 2017.
First Office Action for Taiwanese Application No. 103135808 dated approximately Feb. 27, 2017.
Non-Final Office Action for U.S. Appl. No. 14/801,325 dated Oct. 3, 2017.
Non-Final Office Action for U.S. Appl. No. 12/204,646 dated Sep. 29, 2010.
Final Office Action for U.S. Appl. No. 12/204,646 dated Mar. 2, 2011.
Non-Final Office Action for U.S. Appl. No. 12/204,646 dated Jun. 20, 2011.
Final Office Action for U.S. Appl. No. 12/204,646 dated Nov. 25, 2011.
Non-Final Office Action for U.S. Appl. No. 12/204,646 dated Oct. 4, 2012.
Final Office Action for U.S. Appl. No. 12/204,646 dated Apr. 12, 2013.
Non-Final Office Action for U.S. Appl. No. 13/530,987 dated Apr. 11, 2013.
Final Office Action for U.S. Appl. No. 13/530,987 dated Oct. 21, 2013.
Non-Final Office Action for U.S. Appl. No. 10/084,629 dated Apr. 1, 2003.
Final Office Action for U.S. Appl. No. 10/084,629 dated Nov. 3, 2003.

* cited by examiner

STEAM NOZZLE SYSTEM AND METHOD

PRIORITY CLAIM

This application is a divisional of U.S. patent application Ser. No. 13/922,463 entitled "STEAM NOZZLE SYSTEM AND METHOD" filed Jun. 20, 2013, which claims priority to U.S. Provisional Application No. 61/706,456 entitled "STEAM NOZZLE SYSTEM AND METHOD" filed Sep. 27, 2012, and U.S. Provisional Application No. 61/731,990 entitled "STEAM NOZZLE SYSTEM AND METHOD" filed Nov. 30, 2012, both of which are incorporated herein by reference in their entirety.

BACKGROUND

1. Field of the Invention

The present invention relates to a rotary spray nozzle for ejecting or dispersing a jet of pressurized air, liquid, and/or other medium. More particularly, the present invention relates to a steam cleaning spray nozzle.

2. Description of Related Art

Many conventional devices have been used for cleaning dirt or grime from a surface using high pressure air as source to rotate a nozzle and to generate suction for delivery of cleaning fluid to a material. For example, U.S. Pat. No. 6,883,732 to Hasegawa and U.S. Pat. No. 7,568,635 to Micheli; U.S. Patent Application Publication No. 2009/0057443 to Sendo; International Publication No. 2007/131533 to Jäger; and European Patent Application Publication No. 2255885 to Bosua, all of which are incorporated herein by reference, describe spray guns used to dispense liquids for cleaning material.

Some conventional devices clean a surface by applying steam or vapor to the surface. The heat of the steam will soften the dirt or grime so it may be lifted from the surface. Usually the surface or floor is vacuumed first to remove any loose dirt or dust prior to steam cleaning. Some devices have built-in dispensers that include water and/or cleaning solutions (for example, detergent). Conventional devices, therefore, tend to have a structure that forces a direct stream or mist of a mixture of cleaning fluid or other medium through a wide nozzle of the device. Many conventional devices saturate the cleaning material with water because the amount of steam delivered to the material cannot be regulated. Saturating the material with water, delays the drying time of the material. Many of these devices have wide nozzles and are not suitable for cleaning materials in small areas (for example, vehicle interiors). Other devices are fitted with sponges, brushes, or adsorbing materials that are used to remove excess water. Thus, there is a need for devices that delivers steam in an optimized manner such that dirt is removed with a minimal amount of water.

SUMMARY

Various embodiments of a steam nozzle system and method of use are described herein. In some embodiments, a steam cleaning spray nozzle includes a support member in fluid communication with a steam source, and one or more substantially rigid conduits coupled to the support member. The substantially rigid conduit is in fluid communication with the steam source. A portion of the conduit is angled, and during use, sufficient eccentric force is produced by the steam to rotate the support member such that steam is ejected from an outlet of the substantially rigid conduit at an oblique angle relative to the center to of the substantially rigid conduit.

In some embodiments, a steam cleaning apparatus includes a steam source capable of delivering pressurized steam, a cover coupable to the steam source, and a substantially rigid conduit coupled to the cover. The substantially rigid conduit is in fluid communication with the steam source. A portion of the conduit is angled such that, during use, steam is ejected at an oblique angle from an outlet of the conduit relative to center of the substantially rigid conduit; and, during use, the steam rotates the conduit.

In some embodiments, a steam cleaning spray nozzle, includes a support member in fluid communication with a steam source, a substantially rigid conduit coupled to the support member in fluid communication with the steam source, and a reservoir in fluid communication with the substantially rigid conduit. A portion of the conduit is angled, and, during use, sufficient eccentric force is produced by the steam to rotate the support member such that steam is ejected from an outlet of the substantially rigid conduit at an oblique angle relative to the center to of the substantially rigid conduit. Ejection of steam from the outlet of the substantially rigid conduit creates a negative pressure in the reservoir such that medium is drawn from the supplemental reservoir into the substantially rigid conduit.

In some embodiments, a steam cleaning spray nozzle includes a support member in fluid communication with a steam source, a substantially rigid conduit coupled to the support member, a reservoir in fluid communication with the substantially rigid conduit, the reservoir containing medium, and a controller in communication with the steam source and the reservoir. The substantially rigid conduit is in fluid communication with the steam source. A portion of the conduit is angled. During use, sufficient eccentric force is produced by the steam to rotate the support member such that steam is ejected from an outlet of the substantially rigid conduit at an oblique angle relative to the center to of the substantially rigid conduit. The controller controls the flow of steam and/or medium to the substantially rigid conduit.

In some embodiments, a steam cleaning spray nozzle includes a support member in fluid communication with a steam source, and a plurality of substantially rigid conduits coupled to a plurality of support members. At least one of the plurality of substantially rigid conduits is in fluid communication with the steam source. A portion of the conduit is angled, and wherein, during use, sufficient eccentric force is produced by the steam to rotate a portion of the support member such that steam is ejected from an outlet of at least one of the substantially rigid conduits at an oblique angle relative to the center to of the substantially rigid conduit.

In some embodiments, a method for steam cleaning a material includes coupling a spray nozzle to a steam source; providing steam through an outlet of an angled conduit of the spray nozzle to generate a sufficient eccentric force to rotate the angled conduit such that the steam is delivered from the conduit as an aerosol to a material; and removing debris from the material. In some embodiments, the material is pre-treated with a medium dispensed through the spray nozzle.

In further embodiments, features from specific embodiments may be combined with features from other embodiments. For example, features from one embodiment may be combined with features from any of the other embodiments. In further embodiments, additional features may be added to the specific embodiments described herein.

In further embodiments, steam cleaning is performed using any of the methods, systems, or spray nozzles described herein.

BRIEF DESCRIPTION OF THE DRAWINGS

Advantages of the present invention will become apparent to those skilled in the art with the benefit of the following detailed description and upon reference to the accompanying drawings in which.

Figure 1:
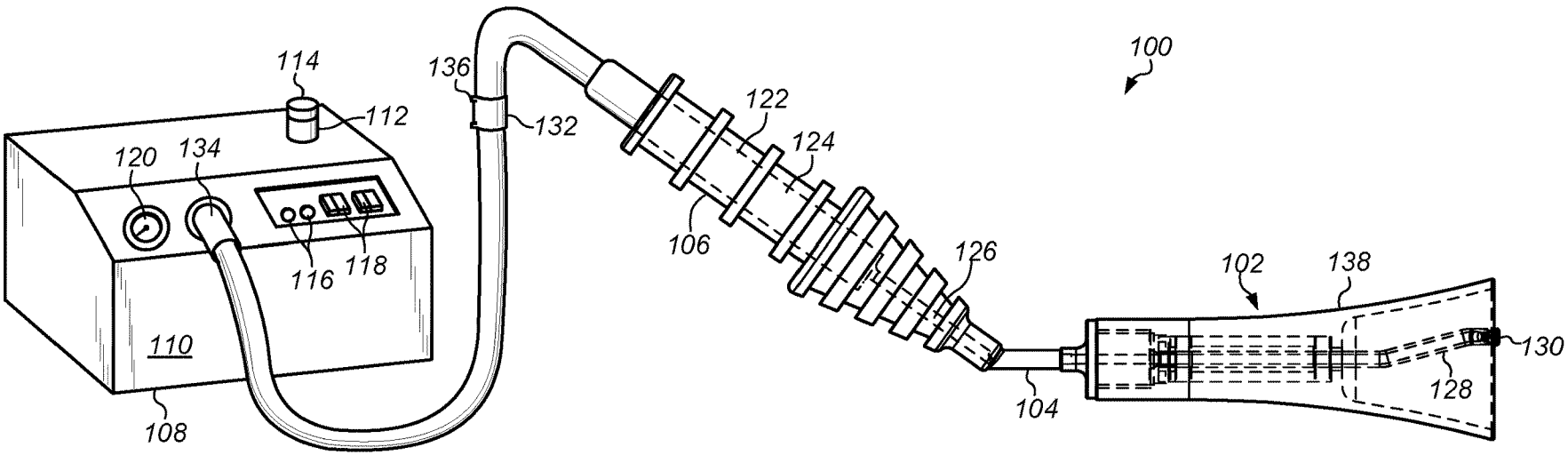
FIG. 1 depicts a perspective side view of a steam cleaning system that includes an embodiment of a steam nozzle.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION

Embodiments described herein provide a spray apparatus for ejecting and dispersing a jet of pressurized steam from a rotating outlet. The steam may include water in the form of a vapor or be substantially water vapor. More particularly, embodiments described herein provide a spray apparatus for allowing the distal end of the nozzle of the spray apparatus to be smoothly turned by the ejection of a small amount of a relatively low-pressure steam regardless of the environmental conditions (e.g., the temperature), while inhibiting fouling or wearing of the nozzle. Portions of the spray nozzle (for example, a steam conduit) may be made of a rigid material that includes a flow passage provided therein for producing an eccentric force created by the ejection of pressurized steam. In some embodiments, rotation of the steam conduit may start immediately upon the ejection of the pressurized steam regardless of the temperature where used.

In certain embodiments, a portion (for example, a steam conduit) of the steam nozzle is stably rotated using low pressure steam. Rotation of the steam conduit causes a unique pattern that disturbs textiles, fabrics and the like, which results in a thorough cleaning. Ejection of the pressurized steam at low pressures may be applied to a delicate object, such as feather fabric. Using low pressure steam makes it possible to achieve cleaning and blasting even when the spray target requires fine spray. As the pressure of the steam is increased, an aerosol spray having a very small diameter with a high spraying force may be produced. The ability to generate a spray and/or aerosol spray allows a variety of materials to be cleaned.

In some embodiments, the spray nozzle includes a conduit. The steam conduit may allow steam to be delivered from a steam reservoir to the material to be cleaned. The steam conduit may be manufactured from a rigid material. For example, the steam conduit may be made from a metal alloy or metallic materials. In some embodiments, the steam conduit is made from stainless steel or aluminum. The steam conduit may include one or more oblique portions (for example, bends or curves). In some embodiments, a portion, or portions, of the conduit may curve at one or more angles ranging from about 1 degree to about 30 degrees, about 10 degrees to about 25 degrees, or from about 20 degrees to about 15 degrees. A shape of the steam conduit may resemble the letter S.

A tip portion of the steam conduit may obliquely extend from the end portion of the steam conduit at an angle ranging from about 1 degree to 30 degrees, about 5 degrees to about 25 degrees, or from about 10 degrees to about 20 degrees. In some embodiments, the oblique angle is about 28 degrees. When steam is flowing through the tip an eccentric force is produced, causing rotation of the steam conduit, and production of a spray at an oblique angle relative to the conduit. Producing a spray at an oblique angle dislodges substances from a material subjected to the spray. For example, dirt, hair or other entrained substances may be dislodged from a carpet. Delivering spray at an oblique angle may reduce the number of times the material to be cleaned is subject to the steam. Thus, the efficiency of the cleaning process is increased.

The steam conduit may have an outlet, or an insert, that is positioned at the end of the nozzle or substantially at the end of the nozzle. The outlet opening may be polyhedral in shape. For example, the outlet may have a rectangular shape or a square shape. A length of the outlet opening may range from about 0.1 mm to about 1 mm. A width of the opening may range from about 0.1 mm up to 1 mm. In some embodiments, the outlet is spherical and has a diameter of ranging from about 0.1 mm to about 1 mm. In some embodiments, the outlet may include two or more openings. In some embodiments, the outlets are positioned along an oblique portion of the conduit. In some embodiments, the outlet may include one or more covers.

The spray nozzle may include a guide or cover that surrounds the steam conduit. In some embodiments, the steam conduit may extend past the guide. The guide may be a spherical in shape. In some embodiments, the guide includes a barrel and an end portion. The end portion of the guide may be flared. For example, the guide may resemble a horn. The guide may be manufactured from materials suitable for steam applications using injection molding or other machining methods known in the art. For example, the guide may be made from a hard plastic material, metal or metal alloys. Since the steam conduit is rigid, there is reduced, or no collision, or wear between the distal end of the nozzle and the inner side of the horn-like guide when the steam conduit is rotated during use. Rotation of the steam conduit causes a unique pattern that results in a thorough cleaning of material.

In some embodiments, the steam nozzle is used as a steam blower that produces a jet of pressurized steam to remove dust from a target area at the extension of the axis of rotation while continuously applying a force of ejection onto a surrounding region about the area. For example, when the fabric or elastic object to be cleaned is fouled with dusts or sticky dirt, the fabric can be cleaned by continuously applying the force of the ejection onto the surrounding region about the dust area, like hitting a futon fabric with a futon stick for lifting and removing dusts.

In some embodiments, the spray nozzle includes on or more bearings. Inclusion of bearing(s) allow the rotating friction acting on the rotary member to be reduced while the rotary member is stably rotated by the ejection of the pressurized steam at a relatively low pressure, a small amount of steam, or at a relatively low temperature. If the spray nozzle includes at least two bearings, a spacer may be positioned between the bearings.

In certain embodiments, the steam nozzle may include frictional components (for example, a brush, and/or rake) that projects from the distal end of the steam nozzle or a cover of the steam nozzle. In such an embodiment, the spray apparatus may directly sweep with the action of the frictional components in addition to providing a force due ejection of the pressurized air, thereby further improving the dust removing capability. In some embodiments, the steam nozzle apparatus includes a crevice tool. The spray may be directed by the contour of the crevice tool components while providing a force due ejection of the pressurized air, thereby further improving the cleaning capability.

Figure 2:
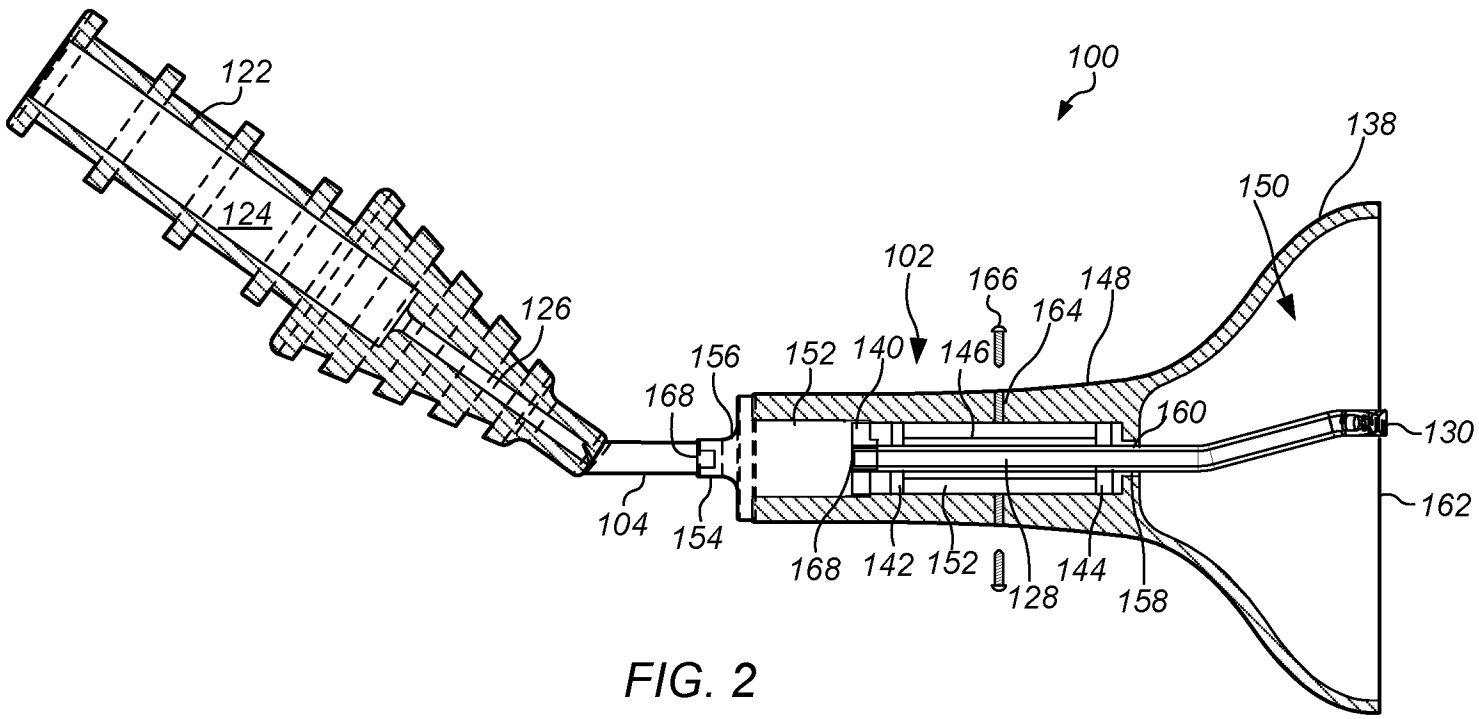
FIG. 2 depicts a cross-sectional view of an embodiment of a steam nozzle.
Figure 3:
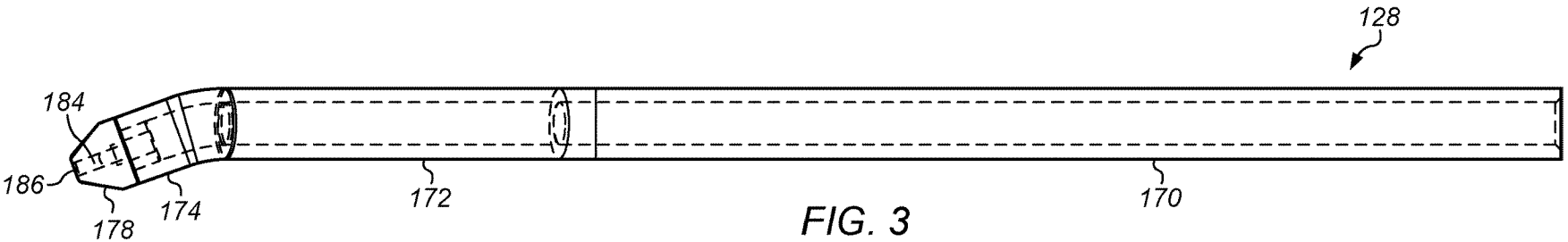
FIG. 3 depicts a perspective side view of an embodiment of a steam nozzle conduit.
Figure 4:
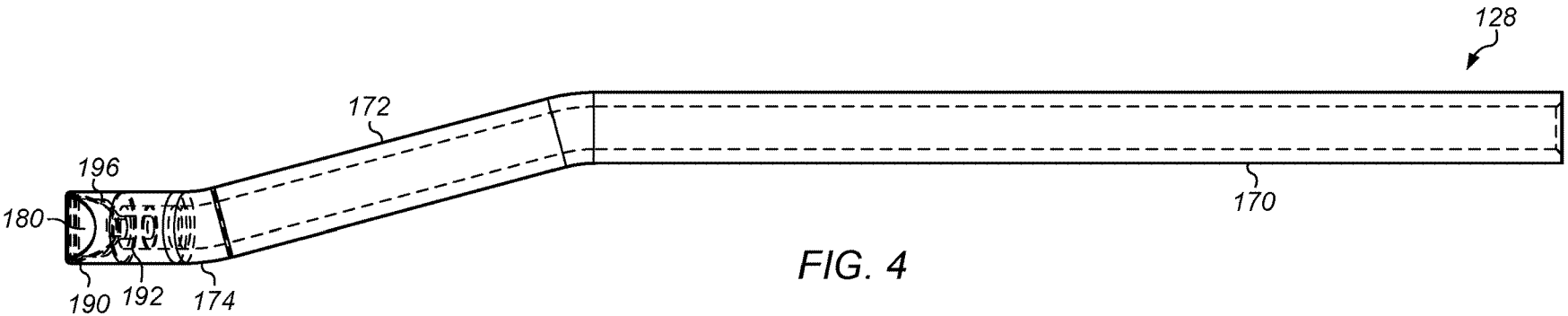
FIG. 4 depicts a perspective side view of another embodiment of a steam nozzle conduit.
Figure 6:
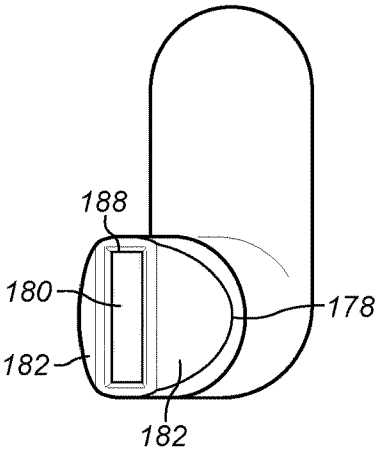
FIG. 6 depicts a perspective end view a tip of a steam nozzle conduit depicted in FIG. 3.
Figure 5:
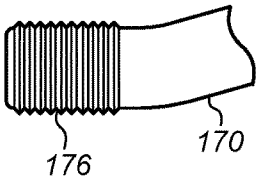
FIG. 5 depicts a perspective side view of an embodiment of side view of a threaded portion of a steam nozzle conduit.
Figure 7:
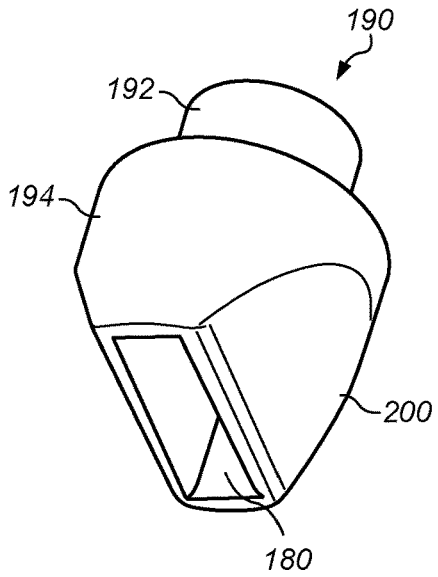
FIG. 7 depicts a perspective view of another embodiment of an insert for a steam nozzle conduit.

FIGS. 1-12 depict embodiments of the steam spray nozzle. FIG. 1 is a perspective side view of an embodiment of the steam cleaning system that includes a spray nozzle. FIG. 2 is a cross-sectional view of an embodiment of the spray nozzle. FIGS. 3 and 4 depict perspective side views of embodiments of steam conduits. FIG. 5 depicts a side view of a threaded portion of the steam conduit. FIG. 6 depicts embodiments of a tip of a steam conduit. FIGS. 7-12 depict embodiments of inserts of the steam conduit.

Referring to FIG. 1, spray cleaning apparatus 100 may include spray nozzle 102, hose connector 104, flexible conduit 106, and steam source 108. Hose connector 104 may couple spray nozzle 102 to flexible conduit 106 which is connected to steam source 108. In some embodiments, hose connector 104 is directly connected (for example, affixed) to flexible conduit 106 and/or steam nozzle 102). In an embodiment, hose connector 104 may be removably coupled to steam nozzle 102 and directly coupled to flexible conduit 106. In some embodiments, flexible conduit 106 is a substantially rigid conduit (for example, a hard plastic or metal conduit).

Steam source 108 may include a reservoir 110, inlet port 112, pressure relief valve 114, one or more indicator lights 116, a power button 118 and pressure gauge 120. In some embodiments, steam source 108 includes a handle and/or warning labels. Steam source 108 may be constructed of hard plastic or any suitable material suitable for generating steam. Steam source 108 may include one or more heating elements (for example, electric heating elements). Steam source 108 may include one or more cords for supply electricity to the heating elements.

Flexible conduit 106 may include an inner conduit 122. Inner conduit 122 may include barrel 124 and tapered portion 126. Steam may enter barrel 124 and flow into tapered portion 126. As the steam flows through tapered portion 126, the steam may undergo compression. Compressed steam may exit tapered portion 126 and enter steam conduit 128 of steam nozzle 102 through hose connector 104. Flow of compressed steam through spray nozzle 102 and steam conduit 128 produces an eccentric force. The eccentric force causes rotation of steam conduit 128 relative to spray nozzle 102, and therefore the output flow of steam is forced out outlet 130 of the steam conduit as a mist or an aerosol of fine drops of steam.

Flexible conduit 106 may include handle 132 and hose connector 134. Handle 132 may include hose holder 136. Handle 132 may be made of hard plastic or any other suitable material. Hose connector 134 removably couples flexible conduit 106 to steam source 108.

Referring to FIG. 2, steam nozzle 102 includes guide (cover) 138, steam conduit 128, support member 140, first bearing 142, second bearing 144, and spacer 146. Guide 138 may include barrel (solid portion) 148 and open portion (horn) 150. Barrel 148 may include bore (passage) 152 that accommodates, steam conduit 128, support member 140, first bearing 142, second bearing 144 and spacer 146. A portion of barrel 148 may be sized to fit a hand so that the guide may be moved back and forth across the material to be cleaned. Barrel 148 may include connector 154 that connects with hose connector 104. In some embodiments, connector portion 154 may be removably coupled to hose connector 104. For example, connector 154 may threadably couple with hose connector 156. Connector portion may include opening 138 that allows steam to enter guide 138 and is in fluid communication with bore 152. Bore 152 may be tapered at the distal end to form neck 158. Neck 158 may end in open portion 150 forming circular opening 160. In some embodiments, neck 158 is not necessary and bore ends in open portion 150 as circular opening 160.

As shown in FIGS. 1 and 2, end 162 of open (horn) portion 150 is flared. In some embodiments, end 162 of horn portion 150 may be tapered or angled to facilitate dislodging of debris from the material being cleaned. In some embodiments, horn portion 150 is removable from barrel 148. For example, horn portion may be slideably coupled to barrel 148. As shown in FIG. 2, barrel 148 includes openings 164.

Openings 164 accepts connectors 166 which allows horn portion 150 to be disconnected from barrel portion 148. Openings 164 and connectors 166 are complimentary to allow horn portion 150 to be removably coupled from barrel portion 148. As shown openings 164 are threaded and connectors 166 are screws. It should be understood that horn 150 may be connected to barrel 148 using couplers known in the art (for example, pins, clamps, hook and loop fastener, or the like).

Steam conduit 128 may extend through barrel 148 into open portion 150. As shown, steam conduit 128 extends past end 162 of guide 138. Steam conduit 128 may couple to support member 140. Support member 140 may be positioned inside of barrel 152. Support member 140 and steam conduit 128 may include complimentary threads that allow the steam conduit to be threaded to the support member. In some embodiments, support member 140 is a metal ring with exterior threads. Support member 140 includes opening 168 that allows fluid communication between the inner portion of steam conduit 128 and steam source 108. Flow of compressed steam from steam source 108 (through flexible conduit 122), into spray nozzle 102 and then into steam conduit 128 produces an eccentric force. The eccentric force causes rotation of support member 140 which in turns rotates steam conduit 128 relative to spray nozzle 102, and therefore the output flow of steam is forced out outlet 130 of steam conduit 128 forming a mist or aerosol of fine drops of steam. In some embodiments, the steam conduit and support member are one piece. Support member 140 may be made of metal or metal alloy materials. In some embodiments, support member is a flange.

First bearing 142 may abut support member 140. Second bearing 144 may abut neck 158. A size of neck 158 may inhibit bearings 142, 144, spacer 146 and support member 140 from moving into open portion 150. Spacer 146 may be positioned between first bearing 142 and second bearing 144. First bearing 142 and second bearing 144 may move (slide) along the outer surface of steam conduit 128. Spacer 146 may move along the outer surface of steam conduit 128 in relationship to the movement of the first and second bearings. The inclusion of one or more bearings allows the rotating friction acting on the steam conduit 128 to be reduced while the steam conduit is stably rotated by the ejection of the pressurized steam at a relatively low pressure, a small amount of steam, or at a relatively low temperature.

The bearings and spacer may be made of materials resistant to steam and/or high pressure steam. For example, the bearings and spacer are made from metallic or metal alloy materials. In some embodiments, the bearings and spacer are made of stainless steel.

Referring to FIGS. 3 and 4, steam conduit 128 includes elongated tubular body portion 170, angled tubular portion 172, and tip 174. Tubular body portion 170 may be suspended inside of guide 138 with tip 174 in proximity to end 162 of the guide. Angled tubular portion 172 and tip 174 may obliquely extend from one end of the elongated tubular body portion at an angle. Angled tubular portion 172 and tip 174 may form an S-shape. For example, angled tubular portion 172 may be angled from about 5 degrees to about 30 degrees, from about 10 degrees to about 25 degrees, or from about 15 degrees to about 20 degrees relative to elongated tubular body potion 166. Tip 174 may be angled from about 5 degrees to about 30 degrees, from about 10 degrees to about 25 degrees, or from about 15 degrees to about 20 degrees relative elongated tubular body portion 166. Angling of tubular portion 172 and tip 174 produces directional components of steam along (for example, parallel to) the axis of rotation and about the axis of rotation. In other words, an aerosol or fine mist of pressurized steam may be ejected from the conduit at an oblique angle relative to the center of the tubular portion of the conduit while the steam conduit is rotating.

In some embodiments, tubular body portion 170 and angled tubular portion 172 are removably coupled. Referring to FIG. 5, tubular body 170 may include threads 176. Angled tubular portion 172 may include complementary threads (not shown) which allows the angled tubular portion to be connected to tubular body portion. In other embodiments, tubular body portion 170 and angled tubular portion 172 are slideably coupled and/or directly connected using pins, hook and loop fasteners or the like. In some embodiments, tubular body portion 170 and angled tubular portion 172 are one piece.

Referring to FIGS. 3 and 6, tip 174 includes an outlet portion 178. Outlet 178 may be coupled to tip 174 as shown in FIG. 3. For example, outlet 178 may be press-fitted or crimped to the outside of tip 174. Outlet 178 may include opening 180, covered portion 182 and bore 184 (shown in FIG. 3). Opening 180 may be positioned off-center, and extend along the open end of tip 174. Covered portion 182 may cover a portion of an inner diameter of steam conduit 128. Bore 184 may be in fluid communication with inner diameter of steam conduit 128 and terminate at the end of opening 180 to form orifice 186 (Shown in FIG. 3). In some embodiments bore 184 extends into inner portion of conduit tip 174 of steam conduit 128. Bore 184 and/or orifice 186 may have a smaller diameter relative to the inner diameter of opening 130 of steam conduit 128. As steam flows through steam conduit 128, covered portion 182 assists in directing the steam that flows outside of bore 184 through opening 180, and thus produces a concentrated flow of stream. As shown, opening 180 is rectangular; however, other shapes are envisioned. Opening 180 may have a length of ranging from about 0.1 mm to about 1 mm and a width ranging from about 0.01 mm to 0.5 mm. Opening 180 may include edges 188 that are raised above the surface of outlet portion 172. Edges 182 may have a smooth finish or be chamfered. Edges 188 may assist in dislodging debris from a material during a cleaning process.

Figure 10:
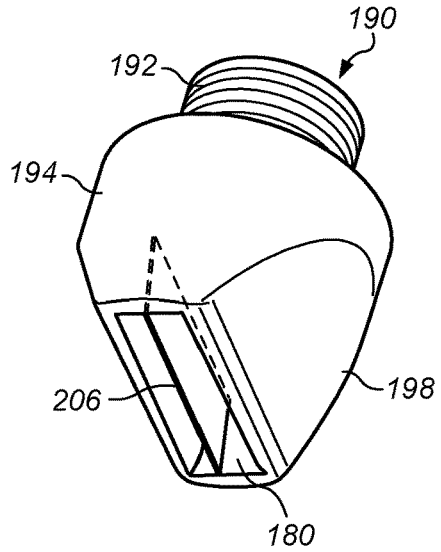
FIG. 10 depicts a perspective view of an embodiment of a steam nozzle conduit insert with a blade.
Figure 8:
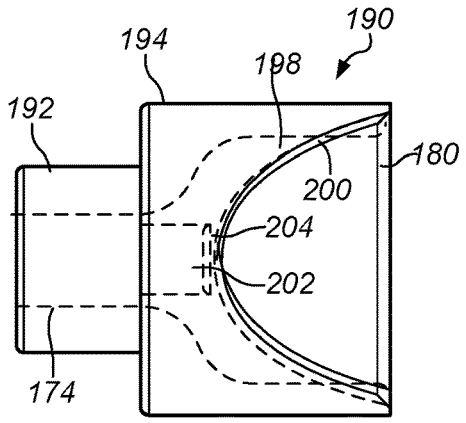
FIG. 8 depicts a perspective side view of the insert depicted in FIG. 7.
Figure 11:
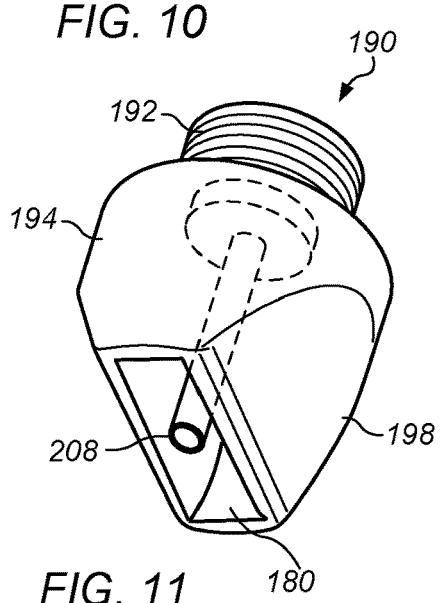
FIG. 11 depicts a perspective view of an embodiment of a steam nozzle conduit insert with a substantially straight conduit.
Figure 9:
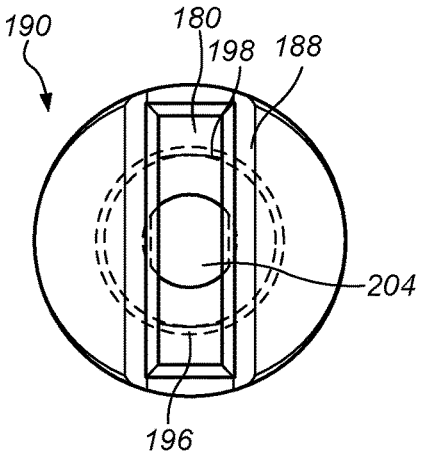
FIG. 9 depicts a perspective end view of the insert depicted in FIG. 7.
Figure 12:
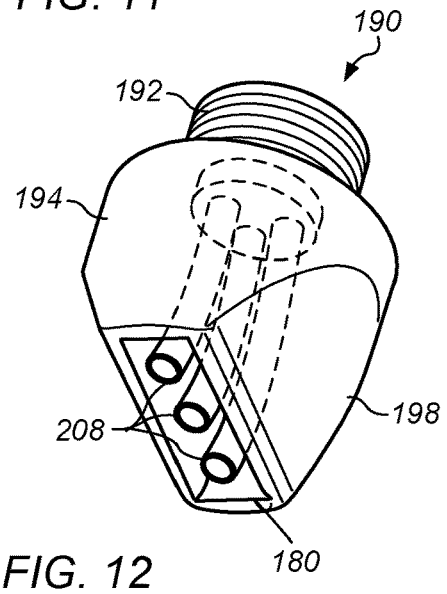
FIG. 12 depicts a perspective view of an embodiment of a steam nozzle conduit insert with a plurality of conduits.

Referring to FIGS. 4 and 7-12, tip 174 includes insert 190. Insert 190 includes connector 192, body 194, bore 196, and opening 180. Connector 192 may be inserted inside of tip 174 as shown in FIG. 4. Tip 174 may be flared so that connector 192 inserts into the tip. Connector 192 may be inserted until walls 198 of tip 174 abut opening 180 of body 194. In some embodiments, connector 192 and body 194 are inserted in tip 174 until end of tip abuts a beveled (sloped) portions 200 of body 194 of the body. Connector 192 and body 194 may be held in place through frictional forces with tip 174. In some embodiments, connector 192 and body 194 are press-fitted in tip 174. In some embodiments, connector 192 fits over tip 174. As shown in FIGS. 10-12, connector 192 is threaded and screws onto a complementary thread of tip 172.

Bore 202 may extend from the end of connector 192 into body 194. Bore 202 may be in fluid communication with steam conduit 128. Termination of bore 202 in body 194 may form orifice 204. In some embodiments, bore 202 may terminate near or proximate the a proximal end of beveled portions 200. Beveled portions 200 may direct steam moving through steam conduit 128 and out opening 180.

Opening 180 of insert 190 may have a length of ranging from about 0.1 mm to about 1 mm and a width ranging from about 0.01 mm to 0.5 mm. Opening 180 may include edges 188. Edges 188 may be beveled such that a portion of the edges overlap a portion of orifice 204 (see FIG. 9). Walls 198 and/or beveled edges 200 may assist in forming a directed mist and/or aerosol spray of steam having enhanced force relative to steam exiting tip 174 without a guide.

Referring to FIG. 10, insert 190 includes blade 206. Blade 208 may be connected to walls of body 194 using epoxying, gluing, welding, soldering, or the like. Blade 208 may be moved by the aerosol force exiting steam conduit 128. Such movement may provide direction (e.g., downward direction) of the aerosol spray.

Referring to FIG. 11 insert 190 includes single conduit 206. Single conduit 206 may be in fluid communication with steam conduit 128. Single conduit 206 may be substantially straight and provide a straight stream of aerosol from steam conduit 128.

Referring to FIG. 12 insert 190 includes a plurality of conduits 206. Conduits 206 may be in fluid communication with steam conduit 128. Conduit 206 may be substantially straight and provide a streams of aerosol from steam conduit 128.

Figure 13A:
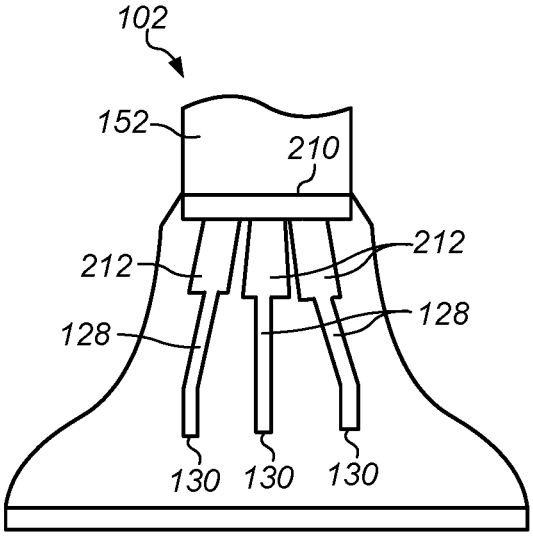
FIG. 13A depicts a perspective view of an embodiment of multiple steam conduits.
Figure 13B:
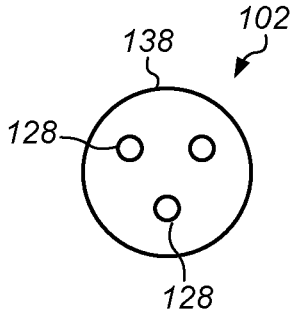
FIG. 13B depicts an end view of an embodiment of the multiple steam conduits of FIG. 14A in an onset pattern.
Figure 14A:
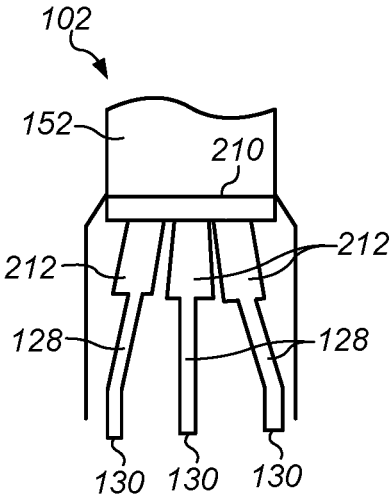
FIG. 14A depicts a perspective view of an embodiment of multiple steam conduits.
Figure 14B:
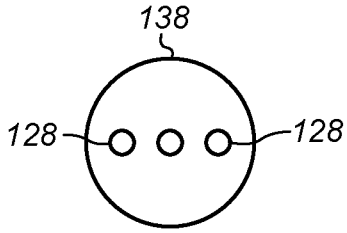
FIG. 14B depicts an end view of an embodiment of the multiple steam conduits of FIG. 15A in a linear pattern.

In some embodiments, steam nozzle 102 may include a plurality of steam conduits 128. For example, steam nozzle 102 may include 2, 3, 4, or more steam conduits. FIGS. 13A through 14B depict perspective views of steam nozzle 102 having three steam conduits 128. Steam conduits 128 may be connected to or a part of manifold 210 in bore 152. Manifold 210 may be similar or the same as support member 140 in FIG. 2. Rotatable members (support member) 212 are coupled to manifold 210 and steam conduits 128. Manifold 210 includes one or more openings that allows fluid communication between the inner portion of steam conduit 128 and steam source 108 (Shown in FIG. 2). Flow of compressed steam from steam source 108 (through flexible conduit 122), through manifold 210 and into steam conduits 128 produces an eccentric force. The eccentric force causes rotation of rotatable member (rotor) 212 which in turns rotates steam conduit 128 relative to spray nozzle 102, and therefore the output flow of steam is forced out outlet 130 of steam conduits 128 forming a mist or aerosol of fine drops of steam. As shown in FIG. 13B, steam conduits are arranged in a staggered configuration (triangle pattern) with cover 138 surrounding the steam conduits. As shown in FIG. 14B, steam conduits 128 are arranged in a linear configuration with guide 138 surrounding the steam conduits. It should be understood that any configuration of steam conduits is contemplated.

A material may be cleaned using the steam spray apparatus as shown in FIGS. 1-14. Steam cleaning apparatus 100 may be used in janitorial applications, commercial applications, domestic applications, vehicle applications, or combination thereof. Materials include, but are not limited to, carpet, floor mats, cloth cushions, vehicle interiors, and the like. For example, vehicle carpet and cloth seats and cloth ceilings may be cleaned using steam cleaning apparatus 100. In another example, carpet, flooring, drapes and/or other surface areas in a house or commercial establishment may be cleaned by applying steam to the material using the steam cleaning apparatus.

Hose connector 134 may be coupled to steam supply 108. Reservoir 110 may be filled with water through inlet port 112 and pressure relief valve 114 may be connected to the port. Power supply 118 (for example, a push button or toggle switch) may be activated. The water may be heated until steam is generated. A pressure of the steam may be read using pressure gauge 120. One or more indicator lights 116 may indicate give a visual indication of the heating process. For example, one indicator light may be red when the water is heating and another indicator may turn green when a sufficient amount of steam is generated. A needle, or digital display, of pressure gauge 120 may change to indicate an internal pressure of reservoir 110.

Flexible hose 106 may be removed from holder 136 and guide 138 may be positioned proximate an area to be cleaned. For example, guide 138 may be positioned about 2 inches to 5 inches above the material. As steam (vapor) flows through barrel 124 of flexible conduit 106, the steam may, in some embodiments, be further compressed, in tapered portion 126 sufficient eccentric force is provided to rotate support member 140 and steam conduit 128. In some embodiments, a lever or switching assembly is used to regulate the amount of steam flowing through the steam conduit 128. Due to the rotation of angled steam conduit 128, steam and medium are ejected at an oblique angle relative to the center of orifice 186 (See, FIG. 3.) as a dispersed spray having sufficient force to dislodge debris (for example, dirt, hair, rocks,) in the material to be cleaned. The steaming process may be repeated until the area is deemed sufficiently clean. Once the material is sufficiently cleaned, the steam reservoir may be turned off.

Figure 15:
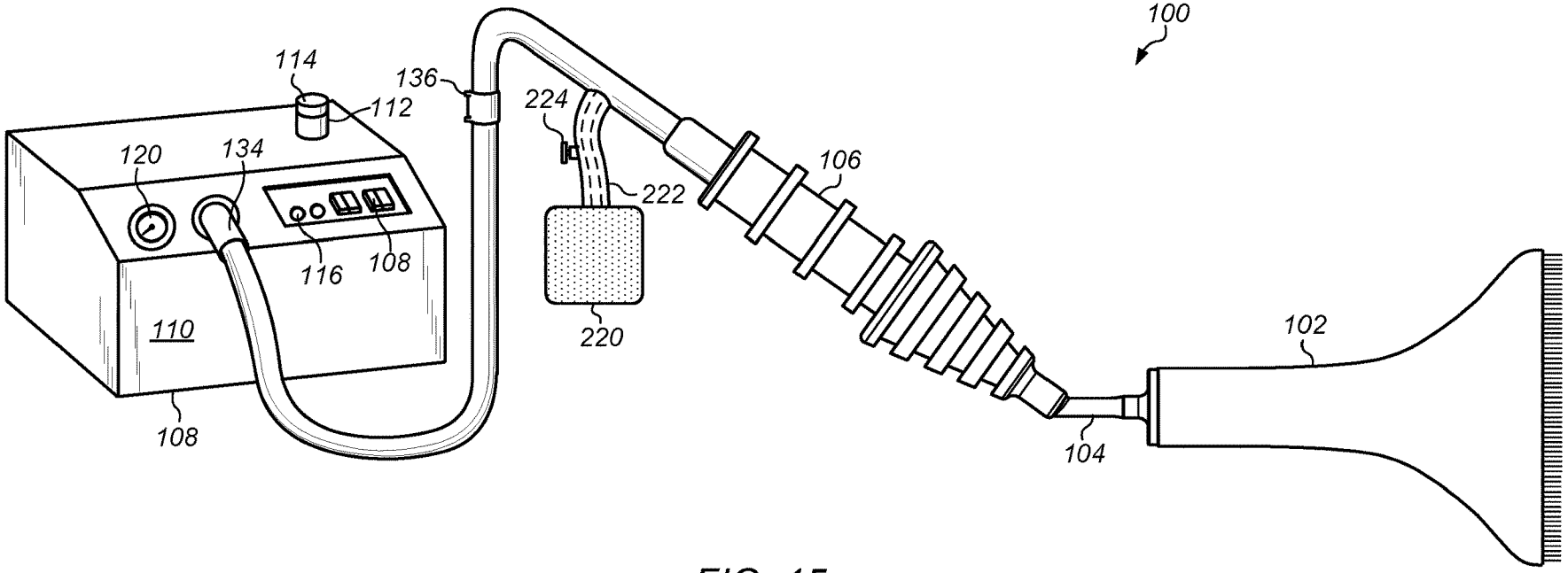
FIG. 15 depicts a perspective side view of an embodiment of a steam cleaning system that includes an embodiment of a steam nozzle and a separate reservoir.

In some embodiments, steam cleaning system has a separate reservoir for medium. Medium may include liquid, solids, or slurries of detergent, biocide, disinfectant and/or other liquids. FIG. 15 depicts a perspective view of steam cleaning apparatus 100 that includes steam nozzle 102 and supplemental reservoir 220.

The spray apparatus 100 of the invention sprays a pressurized steam with force from the tip end of steam conduit 128 to form a negative pressure. Formation of negative pressure may form a partial vacuum in supplemental reservoir 220 and draw medium (for example, liquid and/or granular solids) from the supplemental reservoir, through conduit 222 and into flexible conduit 106. In flexible conduit the medium may mix with the pressurized steam in steam conduit 128 (shown in FIGS. 1-4), and be sprayed out nozzle 102 at an oblique angle relative to the conduit. In some embodiments, the medium is a detergent, and it is formed into an aerosol by the spraying pressure of the pressurized steam, and is blown against the cleaning surface to obtain a cleaning power, and thus the spray apparatus 100 is used as a cleaning spray apparatus.

Conduit 222 may be flexible, rigid, or substantially rigid. Conduit 222 and supplemental reservoir 220 may be made of materials suitable for handling detergents, surfactants and/or other compositions known in the art of cleaning.

The amount of medium drawn into flexible conduit 106 may be regulated using valve 224. As shown, valve 224 includes a handle that may be turned to control the flow of medium. Valve 224 may be any type of valve that controls the flow of fluids from one reservoir to another. For example, valve 224 may be a push button, lever, an electric valve, or the like.

The steam cleaning apparatus as shown in FIG. 15 may be used in janitorial applications, commercial applications, domestic applications, vehicle applications, or combination thereof. A material may be cleaned using the steam spray apparatus with a supplemental reservoir. Materials include, but are not limited to, carpet, flooring, floor mats, cloth cushions, vehicle interiors, and the like. For example, vehicle carpet and cloth seats and cloth ceilings may be cleaned using steam cleaning apparatus 100. In another example, carpet, flooring, drapes and/or other surface areas in a house, or commercial establishment, may be cleaned by applying steam to the material using the steam cleaning apparatus. Hose connector 134 may be coupled to steam supply 108. Reservoir 110 may be filled with water through inlet port 112 and pressure relief valve 114 may be connected to the port. In some embodiments, relief valve is a separate port on reservoir 110. Power supply 118 (for example, a push button or toggle switch) may be activated. The water may be heated until steam is generated. A pressure of the steam may be read using pressure gauge 120. One or more indicator lights 116 may indicate give a visual indication of the heating process. For example, one indicator light may be red when the water is heating and another indicator may turn green when a sufficient amount of steam is generated.

Flexible hose 106 may be removed from holder 136 and guide 138 of steam nozzle 102 may be positioned proximate an area to be cleaned. For example, guide 138 may be positioned about 2 inches to 5 inches above the material. As steam flows through barrel 124 (shown in FIGS. 1 and 2) of flexible conduit 106, sufficient eccentric force from the steam rotates support member 140 and steam conduit 128 (shown in FIGS. 1 and 2). In some embodiments, a lever or switching assembly is used to regulate the amount of steam flowing through the steam conduit 128 (See, for example FIGS. 16 and 17). While steam is being delivered through steam conduit 128, valve 224 may be actuated. For example, the valve may be turned, depressed or electrically activated. Actuation of the valve allows a partial or full vacuum to be pulled in supplement reservoir 220 and medium will be drawn into flexible conduit 106. Due to the rotation of angled steam conduit 128, steam and medium are ejected at an oblique angle relative to the center of orifice 180 as a dispersed spray having sufficient force to dislodge debris (for example, dirt, hair, rocks,) in the material to be cleaned. The steaming process may be repeated until the area is deemed sufficiently clean. Once the material is sufficiently cleaned, the steam reservoir may be turned off.

Figure 16:
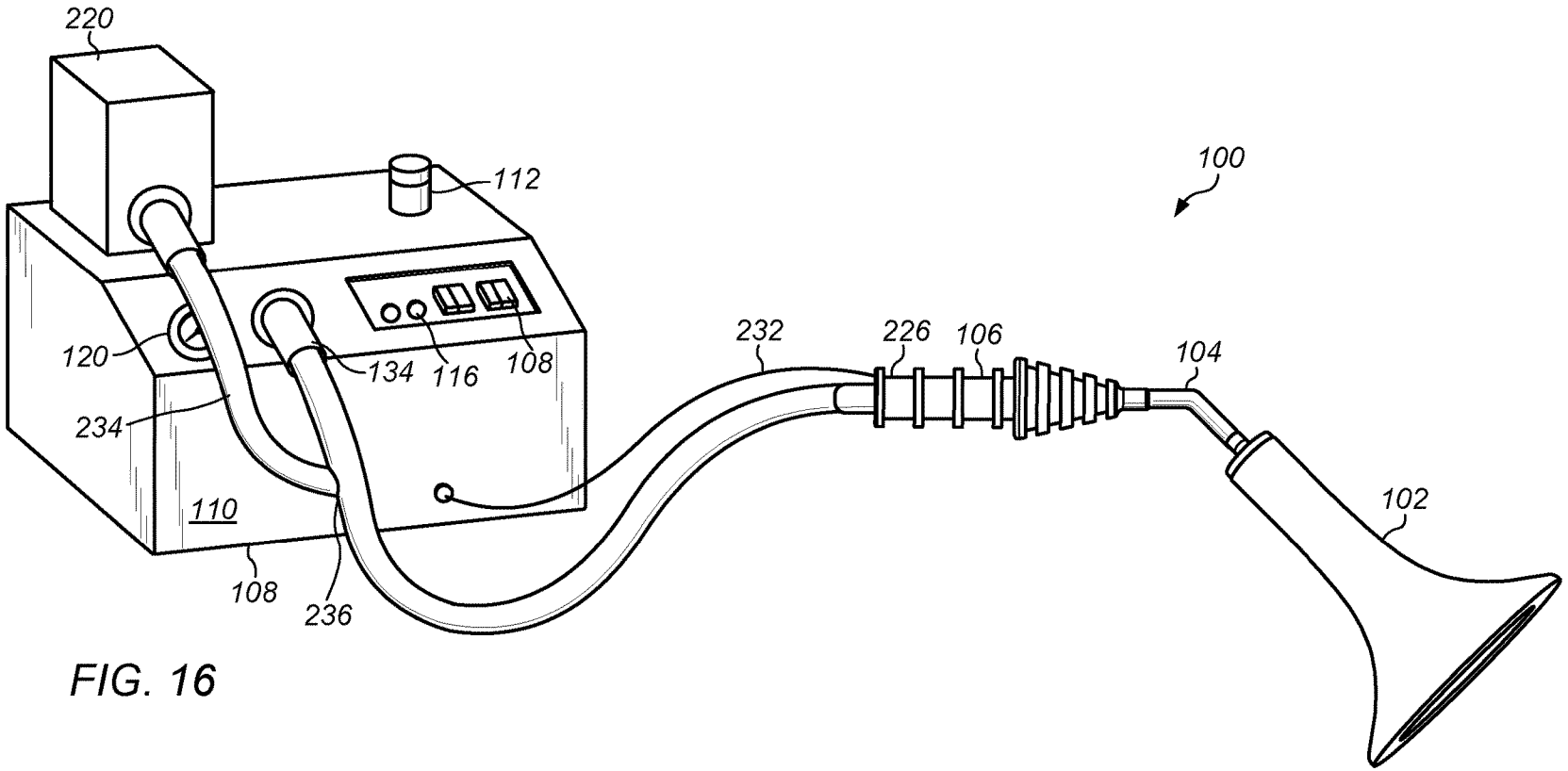
FIG. 16 depicts a perspective view of an embodiment of a steam cleaning apparatus that includes a steam nozzle, a supplemental reservoir, and a controller.
Figure 17:
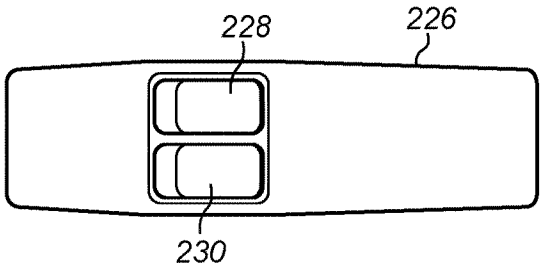
FIG. 17 depicts a top view of the controller depicted in FIG. 16.

In some embodiments, the steam cleaning apparatus may dispense the medium from a separate tank through the hand held nozzle that includes a controller. FIG. 16 depicts a perspective view of steam cleaning apparatus 100 that includes steam nozzle 102, supplemental reservoir 220, and controller 226. FIG. 17 depicts a top view of controller 206.

Supplemental reservoir 220 may include medium suitable for pre-treatment or after treatment of the material. Pre-treatment of the material may include providing a medium to assist in the removal of stains, soil, heavy traffic and the like prior to treatment with steam (vapor). After-treatment may include providing medium to inhibit stain or soiling of the material (for example, Scotchguard®, 3M, St. Paul Minn., USA). The medium may include, but is not limited to, detergents such as anionic detergents, non-anionic detergents, cationic detergents, disinfectant, bactericides, hydrocarbon solvents, halogenated hydrocarbon solvents, alcohols, and glycol ethers.

Handle 106 may include controller 226. Controller 226 may include switches 228 and 220. Switches 228 and 230 may be, but are not limited to, toggle switches). In some embodiments switches 228 and 230 are one unit. In some embodiments, supplemental reservoir is not used and controller 226 only includes one switch to control the flow of vapor from reservoir 110. One or more switches may be electrically connected through cord 232 to one or more electronically controlled valves in fluid communication to reservoir 110 and/or supplemental reservoir 220. Switches 228 and 230 are electrically connected to a power source. For example, switches 228 and 230 may be plug into steam source 108 or be electrically coupled to steam source 108. Steam source 108 may be plug into a power source. Activation of switch 228 (for example, pushing down of switch 228) may open at least one valve member to allow liquid to flow from reservoir 220 through flexible conduit 106 into steam nozzle 102. Switches and valves in reservoirs 110 and 220 may be any switch or valve assembly known in the art. For example, U.S. Pat. No. 7,784,148 to Lenkiwicz et al. and U.S. Pat. No. 7,657,968 to Scott et al., which are incorporated herein by reference, describe switches and valve assemblies for steam cleaners. Conduit 234 may connect supplemental reservoir 220 with hose portion 236. Conduit 234 may be part of conduit 106 or be a separate conduit coupled to steam nozzle 102. Conduit 234 and hose portion 236 may be flexible, rigid, or substantially rigid. Conduit 234 and supplemental reservoir 222 may be made of materials suitable for handling detergents, surfactants, solvents and/or other compositions known in the art of cleaning.

In some embodiments, one or more valves in fluid communication with reservoir 110 and/or supplemental reservoir 220 are mechanical valves. For example, supplemental reservoir 220 may include a knob rotatably mounted to the reservoir. During use, the knob may be manually opened and closed to control the amount of medium dispensed through steam nozzle 102.

The medium may be delivered through nozzle 102 at an oblique angle relative to the steam conduit 128 (shown in FIGS. 1-4). After a sufficient amount of medium is distributed to the material, switch 228 may be deactivated (for example, toggling switch 228 in the opposite direction). Switch 228 may be activated and deactivated (for example, toggled) to control the amount of medium being delivered to the material.

The steam cleaning apparatus shown in FIG. 16 may be used in janitorial applications, commercial applications, domestic applications, vehicle applications, or combination thereof as described herein. Hose connector 134 may be coupled to steam supply 108. Reservoir 110 may be filled with water through inlet port 112. Conduit 234 may be coupled to supplemental reservoir 220. In some embodiments, conduit 234 is coupled to supplemental reservoir 220 and flexible hose 106.

Flexible hose 106 may be removed from holder 136 and guide 138 of steam nozzle 102 may be positioned proximate an area to be cleaned. For example, guide 138 may be positioned about 2 inches to 5 inches above the material. Switch 228 may be activated and medium from reservoir may flow (for example, gravity fed) through conduit 234, flexible hose 106 and be dispensed through tip 170 of steam nozzle onto the material to be pre-treated. Switch 228 may be deactivated after sufficient medium is applied to the material. In some embodiments, medium is dispensed during the application of steam.

During or after applying medium to the material (pre-treatment), power supply 118 may be activated. The water may be heated until steam is generated. A pressure of the steam may be read using pressure gauge 120. One or more indicator lights 116 may indicate give a visual indication of the heating process. Switch 228 may be activated and a valve in reservoir 110 opens to allow steam to exit the reservoir. The steam vapor flows through barrel 124 (shown in FIGS. 1 and 2) of flexible conduit 106, through tapered portion 126 with sufficient eccentric force to rotate support member 140 and steam conduit 128 (shown in FIGS. 1 and 2). In some embodiments, while steam is being delivered through steam conduit 128, switch 228 may be actuated and medium or additional medium may be dispensed with the steam. Due to the rotation of angled steam conduit 128, vapor and medium are ejected at an oblique angle relative to the center of orifice 186 as a dispersed spray having sufficient force to dislodge debris (for example, dirt, hair, rocks,) in the material to be cleaned. The steaming process may be repeated until the area is deemed sufficiently clean. Once the material is sufficiently cleaned, the steam assembly may be turned off.

Figure 20:
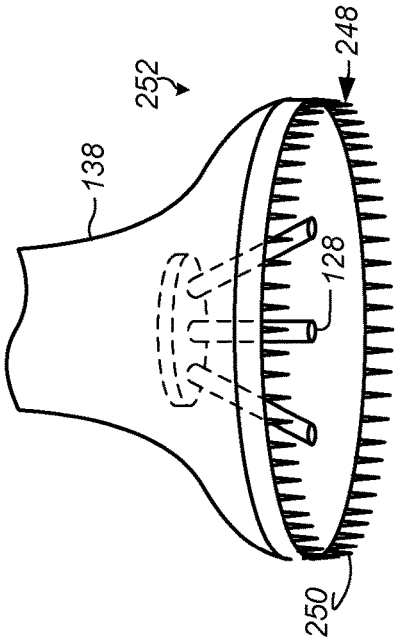
FIG. 20 depicts a perspective side view of an embodiment of a steam nozzle conduit in combination with a rake.
Figure 21:
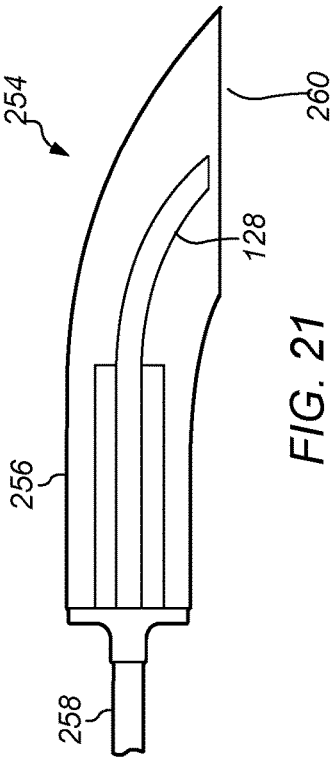
FIG. 21 depicts a perspective side view of an embodiment of a steam nozzle conduit in combination with a crevice tool.
Figure 18:
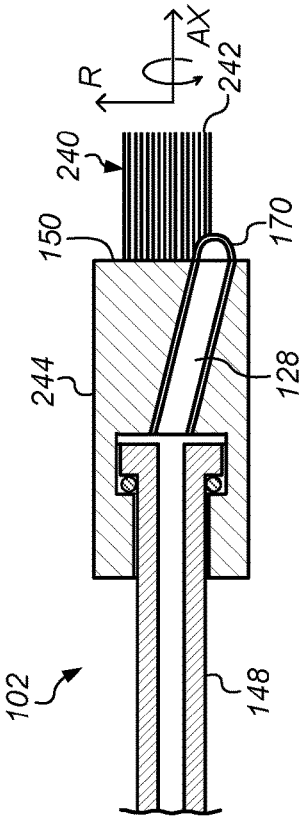
FIG. 18 depicts is a partially longitudinally cross-sectional side view of an embodiment of a steam nozzle with a brush.
Figure 19:
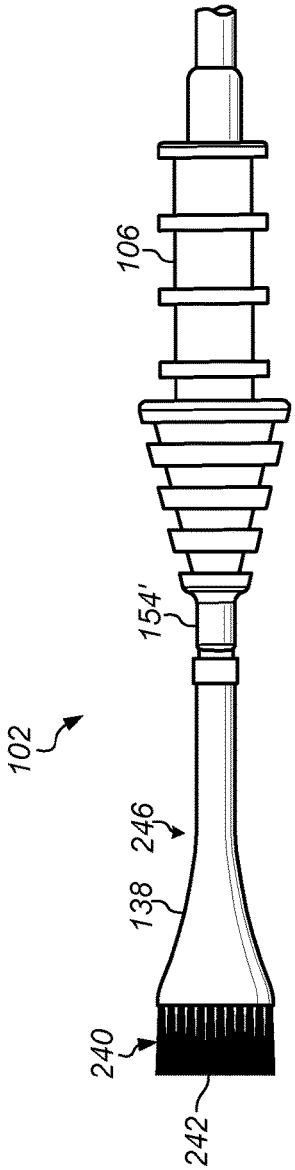
FIG. 19 depicts a perspective side view of another embodiment of a steam nozzle with a brush attachment.

In some embodiments, guide portion 138 of steam nozzle 102 may include various attachments and/or end accruements as shown in FIGS. 18-21. FIG. 18 depicts is a partially longitudinally cross-sectional schematic (side) view of a steam nozzle 102 with a brush. FIG. 19 depicts a perspective side view of a brush in combination with the steam nozzle. FIG. 20 depicts a front view of steam nozzle 102 with a rake. FIG. 21 depicts a side view of a steam nozzle with a crevice tool.

Referring to FIGS. 18 and 19, brush 240 includes bristles 242. Bristles 242 may be fabricated from plastic, hair or other suitable materials known in the art for brushes. In some embodiments, bristles 242 are manufactured from materials resist and/or tolerant elevated temperatures. For example, bristles 242 may be made from plastic material. During use, brush 240 may be moved such that bristles 242 contact the material to be cleaned. For example, guide 138 may be moved in a back and forth direction across the material to be cleaned.

Referring to FIG. 18, steam nozzle 102 includes rotor 244. Rotor may be coupled or affixed to bore 148 and include brush 240 disposed on the end thereof. U.S. Patent Application Publication No. 2009/0057443 to Sendo, which is incorporated herein in its entirety by reference describes such a brush and rotor combination. As rotor 244 is rotated by the counter force of the ejection of the pressurized steam (vapor), brush 240 rotates about the axis of rotation to physically clean up the surface to be blown in the direction of rotation. Also, as brush 240 is urged in the radial direction by the expanding and rotatably dispersing the pressurized air ejected from the open portion 150, its cleaning effect involves a combination of blowing in both the direction of rotation and the radial direction of the pressurized air.

Various methods of mounting the brush 240 on the rotor 244 may be employed. As shown, the brush 240 is located closer to the axis of rotation (AX) than tip 174 of steam conduit 128. and can thus prevent the vapor ejected from the tip 174 from flowing towards the axis of rotation (towards the center) and permit the dust accumulated across the extension of the axis of rotation to be blown by the surrounding jet of the vapor ejected from the tip 174. Thus, lifting and removing dust will be enhanced.

Referring to FIG. 19, bristles 242 may be directly attached to of guide 138 to form brush 240. In some embodiments, brush 240 is a separate attachment 246. Brush attachment 246 may be the same as guide 138 described herein with bristles 238 attached to or incorporated in the end of guide 138. During use, guide 138 may be removed from hose attachment 104 and replaced with brush attachment 246. For example, connector portion 154 (shown in FIG. 2) may be unthreaded from hose attachment 104 to remove guide 138 and brush attachment 246 may be threaded on hose attachment with connector portion 154'.

Referring to FIG. 20, end of guide 138 may include rake 248. Prongs 250 of rake 248 may be manufactured from plastic and/or metal. Prongs 250 are substantially rigid and do not bend (substantially inflexible) when moved across a material. As shown, prongs 250 are tapered or pointed at the end, however, any end shape suitable for raking a piece of material (e.g., carpet or mat) is envisioned. In some embodiments rake 248 is a separate attachment 252. Rake attachment 252 may be the same as guide 138 described herein with prongs 250 attached to or incorporated in the end of guide 138. During use, guide 138 may be removed from hose attachment 104 and replaced with rake attachment 252. For example, connector portion 154 (shown in FIG. 2) may be unthreaded from hose attachment 104 to remove guide 138 and rake attachment 242 may be threaded on hose attachment with connector portion 154' (shown in FIG. 19). During use, rake 248 may be moved such that prongs 250 contact the material to be cleaned. For example, rake attachment 252 (or guide 138) may be moved in a back and forth direction across the material to be cleaned. As shown, rake attachment 252 covers a plurality of steam conduits 218.

Referring to FIG. 21, guide 138 may be replaced with crevice tool 254. Crevice tool 254 may be used to clean that are beyond the cleaning path obtained by manipulating the steam nozzle (for example, crevices of flooring, under furniture, under seats in a car, between seats and a car accessory compartment between seats). Crevice tool 254 may be an elongated rigid tube that connects to connector portion 154 of hose attachment 104. Crevice tool 254 includes body 256 and connector 258. Body 256 may be made of rigid material (for example, plastic or metal). Body 256 is hollow and has at least partially elongated, generally tubular-shape having wall that generally taper or converge toward one another with increasing distance from connector 258. The walls of body 256 terminate at opening 260 and cover steam conduit 128. Opening 260 may be rectangular in cross section so that the longitudinal axis of the opening substantially exceeds the lateral axis of the opening. Connector 256 is complementary to connector portion 154 (for example, threaded and/or tapered to slide over connector portion 154 for a friction fit) of hose attachment 104. As shown, steam conduit 128 is inside opening 260. In some embodiments, steam conduit 128 extends past opening 260. In some embodiments, crevice tool 254 is directly attached to hose 106.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. The words "include", "including", and "includes" mean including, but not limited to.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

What is claimed is:

1. A steam cleaning apparatus, comprising:

a steam source, wherein the steam source is capable of delivering pressurized steam;

a guide couplable to the steam source;

a rigid, rotatable conduit coupled to the guide, the rotatable conduit in fluid communication with the steam source, wherein a portion of the rotatable conduit is angled such that, during use, steam is ejected at an oblique angle from an outlet of the rotatable conduit relative to a center of the rotatable conduit; and a second conduit coupled between, and in fluid communication with, the steam source and the rotatable conduit, wherein the second conduit is shaped to compress the steam as the steam flows through the second conduit, the compressed steam causing rotation of the rotatable conduit when the compressed steam flows through the rotatable conduit.

2. The steam cleaning apparatus of claim 1, wherein the rotatable conduit is press-fitted inside the guide.

3. The steam cleaning apparatus of claim 1, wherein a size of the outlet of the rotatable conduit is about 1 mm.

4. The steam cleaning apparatus of claim 1, wherein the outlet of the rotatable conduit is chamfered.

5. The steam cleaning apparatus of claim 1, wherein a shape of the outlet of the rotatable conduit is a rectangle.

6. The steam cleaning apparatus of claim 1, further comprising a hose coupled between the steam source and the guide.

7. The steam cleaning apparatus of claim 1, further comprising a hose coupled between the steam source and the guide, wherein the hose comprises a flexible portion and a substantially solid portion.

8. The steam cleaning apparatus of claim 1, further comprising a hose coupled between the steam source and the guide, wherein the hose comprises a handle.

9. The steam, cleaning apparatus of claim 1, further comprising a hose connected to the guide, wherein the hose includes the second conduit.

10. The steam cleaning apparatus of claim 1, wherein the rigid conduit comprises a bore through a rigid rotor.

11. A method for steam cleaning a material, comprising:

providing steam to a spray nozzle, the spray nozzle comprising an angled conduit;

compressing steam as the steam flows through a second conduit coupled to the spray nozzle;

providing the compressed steam through an outlet of the angled conduit of the spray nozzle to generate a sufficient force to rotate the angled conduit and deliver steam from the outlet to a material; and removing debris from the material.

12. The method of claim 11, wherein the steam is pressurized.

13. The method of claim 11, wherein the steam is delivered at an oblique angle relative to the center of the angled conduit.

14. The method of claim 11, wherein the angled conduit is rigid.

15. The method, of claim 11, wherein the debris comprises dirt and/or hair.

16. The method, of claim 11, wherein the material comprises material from a vehicle interior.

17. A steam cleaning spray nozzle, comprising:

a rigid conduit in fluid communication with a steam source, wherein a portion of the conduit is angled;

a second conduit coupled between, and in fluid communication with, the steam source and the rigid conduit, wherein the second conduit is shaped to compress the steam as the steam flows through the second conduit, the compressed steam causing rotation of the rigid conduit when the compressed steam flows through the rigid conduit such that steam is ejected from an outlet of the rigid conduit at an oblique angle relative to a center of the rigid conduit;

a reservoir in fluid communication with the rigid conduit, wherein ejection of steam from the outlet of the rigid conduit creates a negative pressure in the reservoir such that medium is drawn from the supplemental reservoir into the rigid conduit; and a controller in communication with the steam source and the reservoir, wherein the controller controls the flow of steam and/or medium to the rigid conduit.

* * * * *